US006751910B2

(12) United States Patent
Richardson

(10) Patent No.: US 6,751,910 B2
(45) **Date of Patent: *Jun. 22, 2004**

(54) BOX GUTTERS

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/351,663

(22) Filed: Jan. 27, 2003

(65) Prior Publication Data

US 2003/0115807 A1 Jun. 26, 2003

Related U.S. Application Data

(63) Continuation of application No. 09/794,473, filed on Feb. 27, 2001, now Pat. No. 6,560,933.

(30) Foreign Application Priority Data

Feb. 28, 2000 (GB) ..... 0004711

(51) Int. Cl.[7] ..... E04D 13/064

(52) U.S. Cl. ..... 52/11; 52/16

(58) Field of Search ..... 52/11, 16, 13, 52/14, 15

(56) References Cited

U.S. PATENT DOCUMENTS

| | | | |
|---|---|---|---|
| 3,784,235 | A | 1/1974 | Kessler et al. |
| 3,913,284 | A | 10/1975 | Hall |
| 4,632,342 | A | 12/1986 | Skinner |
| 5,406,756 | A | 4/1995 | Bemis et al. |

FOREIGN PATENT DOCUMENTS

| | | | |
|---|---|---|---|
| DE | 26 30 480 | A | 1/1978 |
| DE | 43 24 463 | A1 | 1/1995 |
| GB | 2193982 | | 2/1983 |
| GB | 2274122 | A | 7/1994 |
| GB | 2327955 | A | 2/1999 |

*Primary Examiner*—Michael Safavi
(74) *Attorney, Agent, or Firm*—Wood, Phillips, Katz, Clark & Mortimer

(57) ABSTRACT

A box gutter connector is in the form of a trough having first and second limbs for connection to gutters, one limb being for connection to a box gutter and having its outer surface shaped to aid spread and keying of adhesive/sealant between the connector and the box gutter.

4 Claims, 6 Drawing Sheets

BOX GUTTERS

CROSS-REFERENCE TO RELATED APPLICATION

This application is a continuation of U.S. patent application Ser. No. 09/794,473 which was filed on Feb. 27, 2001 now U.S. Pat. No. 6,560,933 B2.

DESCRIPTION

This invention concerns box gutters and, in particular, concerns connectors for box gutters into external positioned gutters.

Box gutters are usually situated between a roof sloping down to an existing wall or between two roofs sloping down towards each other. These box gutters will lead to conventional guttering on the outside of building or roof. It is important, however, to ensure that the seal between a box gutter and its connection to the exterior gutter is watertight. Otherwise, it may be possible for water to penetrate between the box gutter and the connector and enter the space below the box gutter i.e. internally of the building.

Connectors are used to join the two gutter sections and the connection into the box gutter is usually sealed with a sealant or adhesive, typically of silicone. However, with conventional box gutter connectors, it is possible for the adhesive to be spread unevenly between the connector and the box gutter and for air pockets to be formed. Thus, there may well be weaknesses in the bonding between the box gutter and the connector that can ultimately fail allowing water ingress between the two.

An object of this invention is to provide an improved connector for joining box gutters to external gutters, whereby greater consistency in achieving a water tight seal is possible.

According to the present invention there is provided a box gutter connector in the form of a trough having first and second limbs for connection to gutters, one limb being for connection to a box gutter and having its outer surface shaped to aid spread and keying of adhesive/sealant between the connector and the box gutter.

Preferably the connector has one or more grooves in its outer surface that serve to push and spread adhesive as the connector is slid into the box gutter. Preferably two spaced grooves are provided. The groove or grooves preferably has or have a first face substantially perpendicular to the outer surface of the connector and a second face angled forwardly from said first face towards the free end of the connector limb.

The free end of the connector limb for the box gutter connection is preferably also stepped on its outer surface. The step on the base of the trough is preferably narrower than the steps on the sides of the connector.

Top edges of the connector limb for the box gutter are preferably sloped downwards generally from the region of the above-mentioned grooves, whereby the connector can ride over sealant to a certain extent during installation of the connector.

The limb of the connector into the box gutter is preferably provided with means for urging the limb onto the adhesive when in position. That means may take any suitable form, for example, pivotable toggles that can be pivoted to act against part of the box gutter, wedges, camming means or metal straps The position of the urging means is important to allow physical access thereto and to achieve suitable compression on the adhesive/sealant to produce a desired thickness and spread of adhesive/sealant between the connector and the box gutter.

The connector preferably has abutment means for correct spacing of the connector relative to a support for the exterior gutter. Typically a spigot on the limb of the connector for connection to the exterior gutter can be provided to abut against, for example, the eaves beam to which the exterior gutter is mounted.

Connectors of the invention can include connections, for down-pipes.

Ideally the box gutter connectors of the invention will be produced by injection moulding.

This invention will now be further described, by way of example only, with reference to the accompanying drawings, in which.

Figure 1:
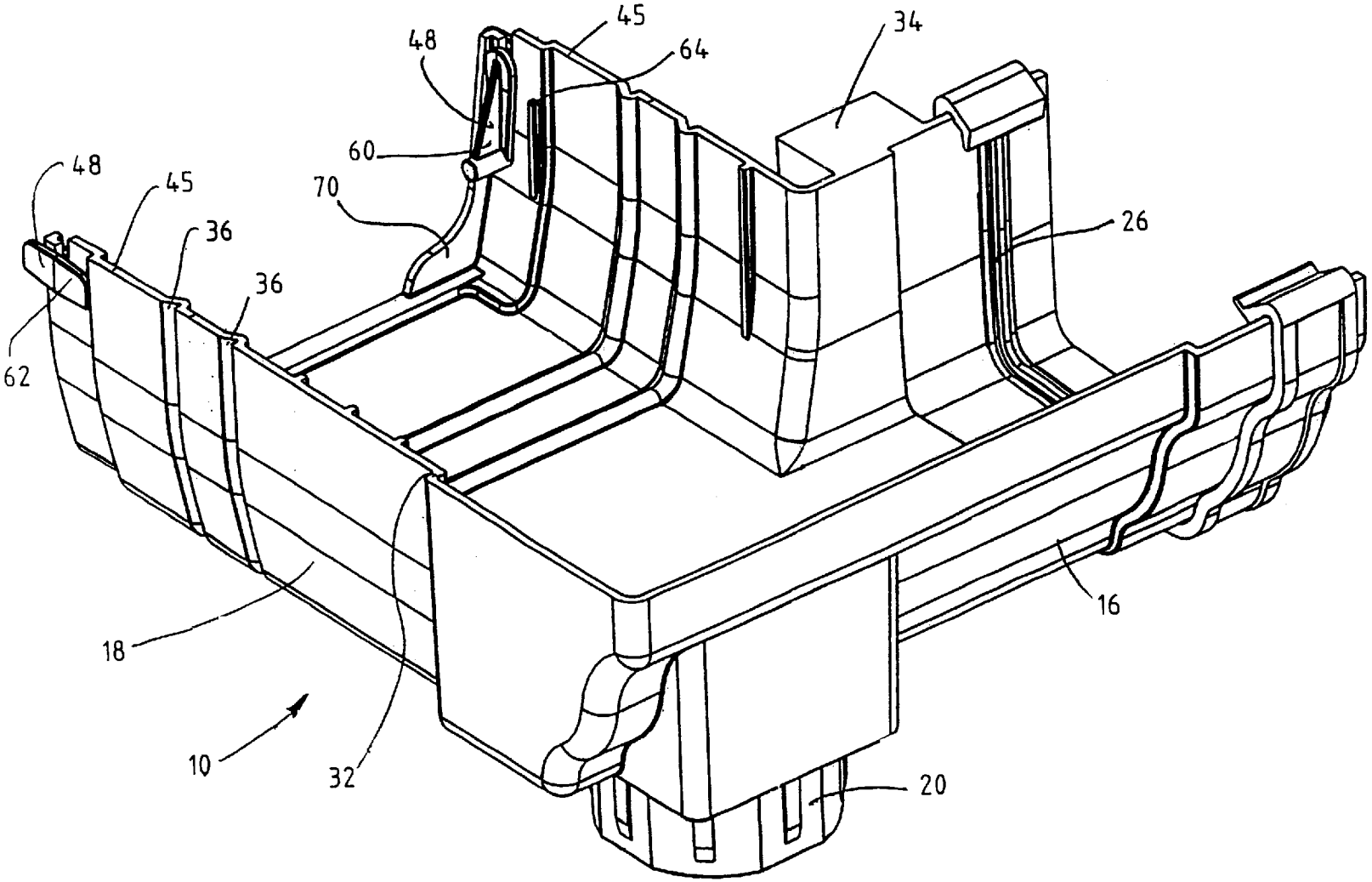
FIG. 1 shows a box gutter connector from above.
Figure 2:
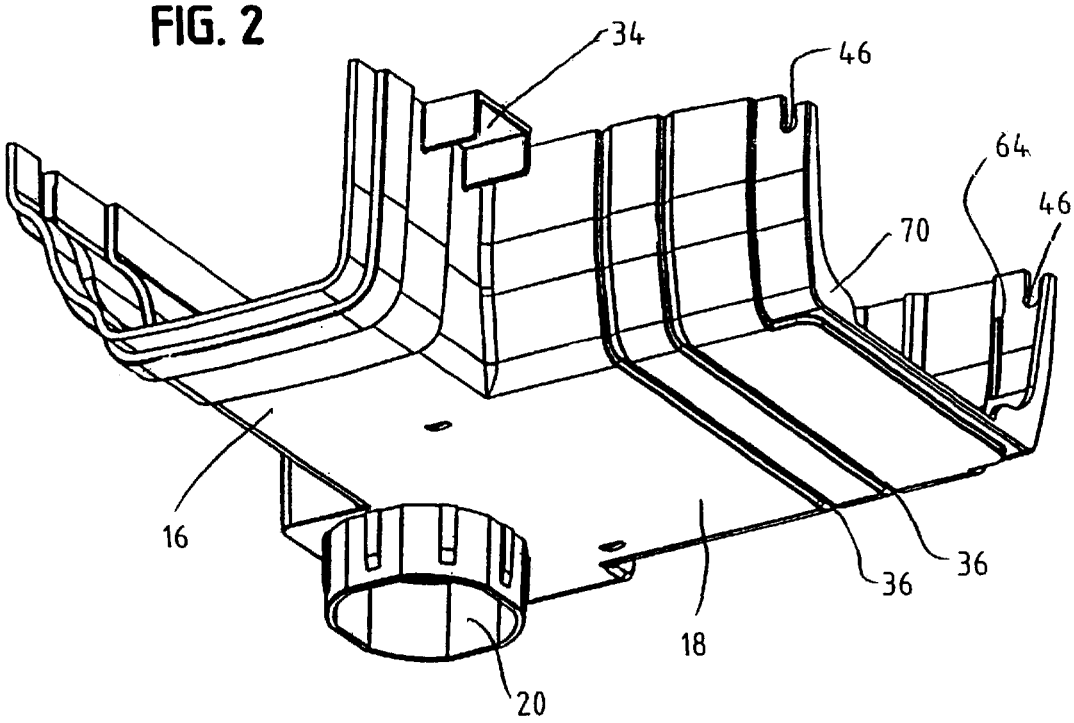
FIG. 2 shows the connector of FIG. 1 from below.
Figure 3:
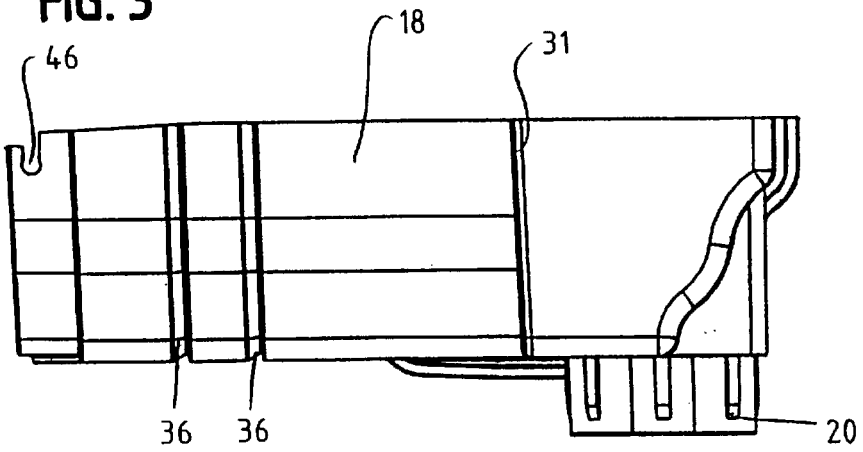
FIG. 3 is a side view of the box gutter connector of FIG. 1.

Referring to the accompanying drawings, a box gutter connector 10 is shown for use in connecting a box gutter 12 to an exterior gutter 14. The connector 10 is a generally L-shaped trough in plan. The connector has a first limb 16 for connection to gutter 14 and a second limb 18 for connection to the box gutter 12. In its corner, the connector has an opening 19 leading to a down-pipe connector 20.

The gutter 14 is mounted on eaves beam 22 by support brackets 24. An internal strengthening strap 26 is shown. The box gutter 12 may be mounted on one side to a wall or like structure and on its opposite to an eaves beam of a roof. Alternatively, the box gutter 14 may be mounted between two roofs sloping towards each other.

The first limb 16 of the connector has a profile enabling it to slidably fit outside of the gutter 14. In other words, the end of the first limb 16 is stepped to accommodate the gutter. Suitable sealing means will usually be provided between the connector and the gutter, such as a deformable elastomeric strip in groove 27 of the stepped end of the connector.

The box gutter has on opposite sides internal inverted L-shaped ribs 28 and the second limb 18 of the connector is sized to slide into the box gutter with its opposed top edges under the ribs 28. So that the connector 10 is inserted into the box gutter to a desired extent, outer side 30 is stepped at 32 and on the eaves beam 22 side of the first limb 16 is an abutment 34 that stops against the eaves beam 22 when the connector is correctly fitted.

Figure 4:
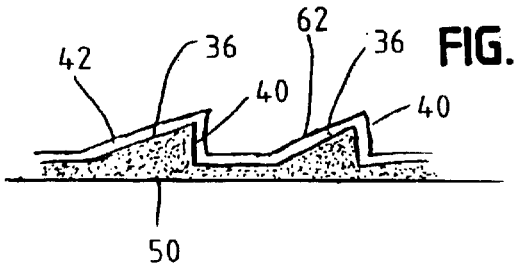
FIG. 4 shows detail of the connector of FIG. 1.
Figure 5:
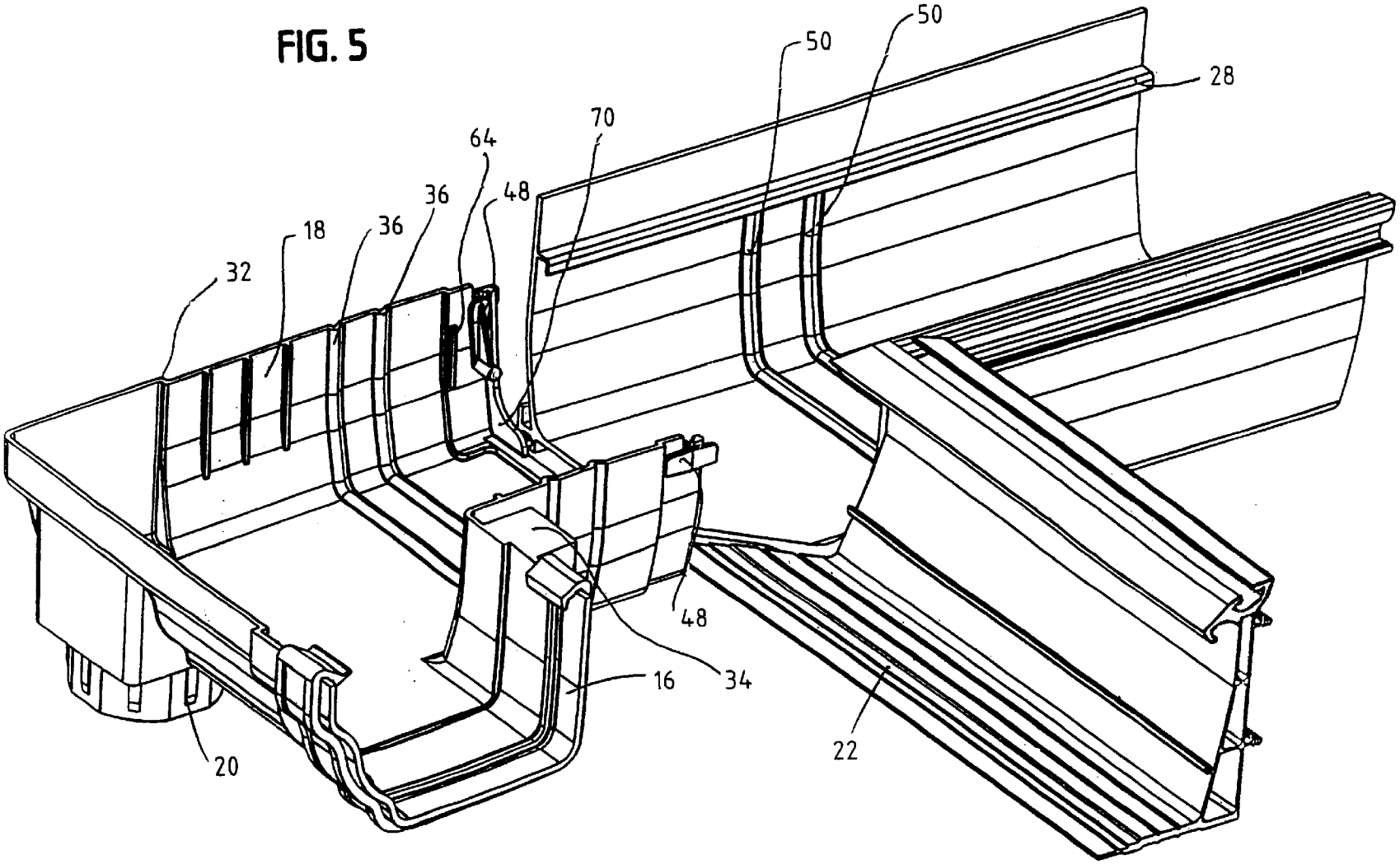
FIG. 5 shows the connector of FIG. 1 being offered up to a box gutter.

The second limb 18 has in its outer surface a pair of grooves 36. The grooves 36 have a first face 40 generally perpendicular to the sides of the limb and a second angled face 42 (FIG. 4). The reason for this shaping of the grooves will be explained later.

The free end of the limb 18 has a stepped outer face. The stepping is narrower (43) on its bottom surface and wider (44) on its sides. Again the reason will be explained later. The limb 18 has its top edge sloping downwards (45) slightly from the region of the grooves 36 towards its free end, whereat the sides have downwards slots 46 for toggles 48.

Figure 6:
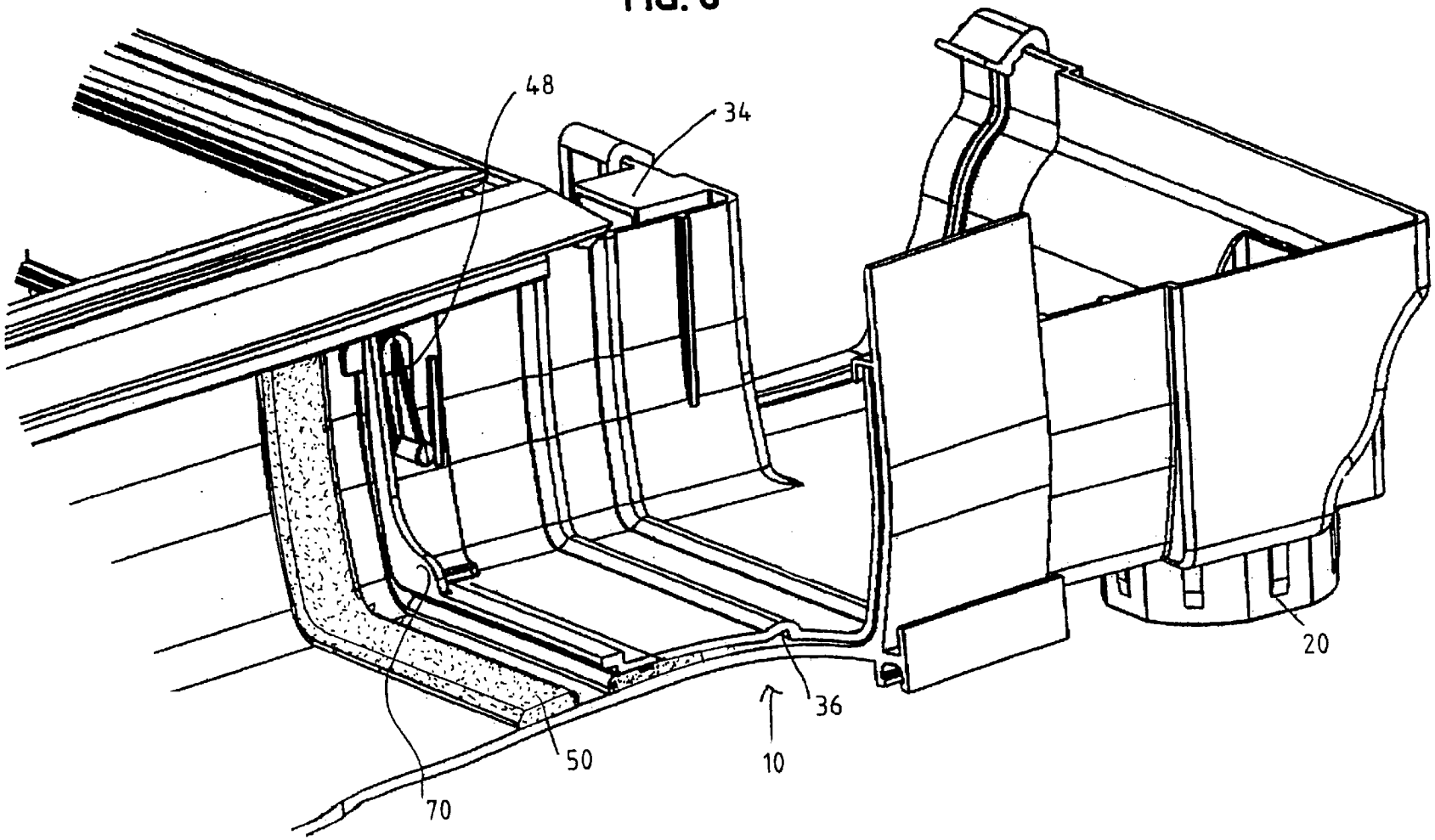
FIG. 6 shows the connector being fitted to a box gutter.
Figure 7:
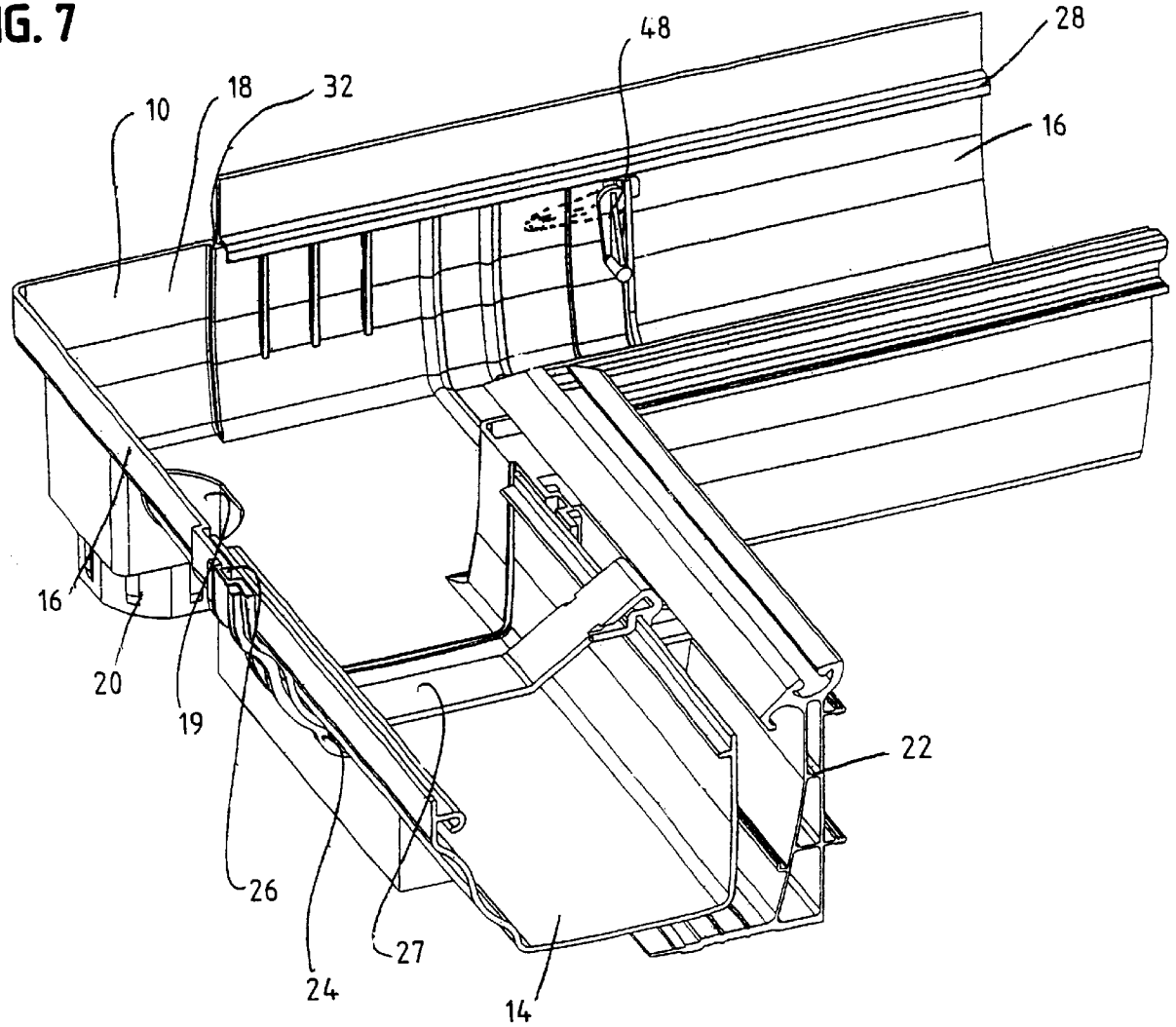
FIGS. 7 and 8 shows the box gutter and connector assembled.

The join between the connector 10 and the box gutter 14 is made by means of adhesive/sealant. The adhesive 50 is applied to the inner face of the box gutter in, for example, two strips in a region over which the grooves 36 will pass when the connector is fully fitted. The amount of adhesive/sealant used may be metered or pre-measured to achieve a desired thickness thereof. The connector 10 is then pushed into the box gutter end and because of the sloping top edges of the connector, it will enter the box gutter at a slightly upwards angle (see. FIG. 6). That together with the shaped grooves 36 helps the connector to smear over the adhesive initially until the sealant meets the grooves which promote a snow plough effect to spread the adhesive between the connector and the box gutter. Because the grooves have vertical faces 40 which push against the adhesive, the adhesive will be forced into the grooves to provide a bonding key. Furthermore, the stepping at the end of the connector limb 18 is provided to improve adhesive flow and distribution between connector and the box gutter. In effect the connector via its grooves 36 and stepped end acts like a snow plough in spreading the adhesive/sealant substantially evenly between the connector and the box gutter.

When the connector is fully pushed into the box gutter and whilst the adhesive is semi-flexible, the toggles 48 are used to force the connector down into the adhesive.

Figure 8:
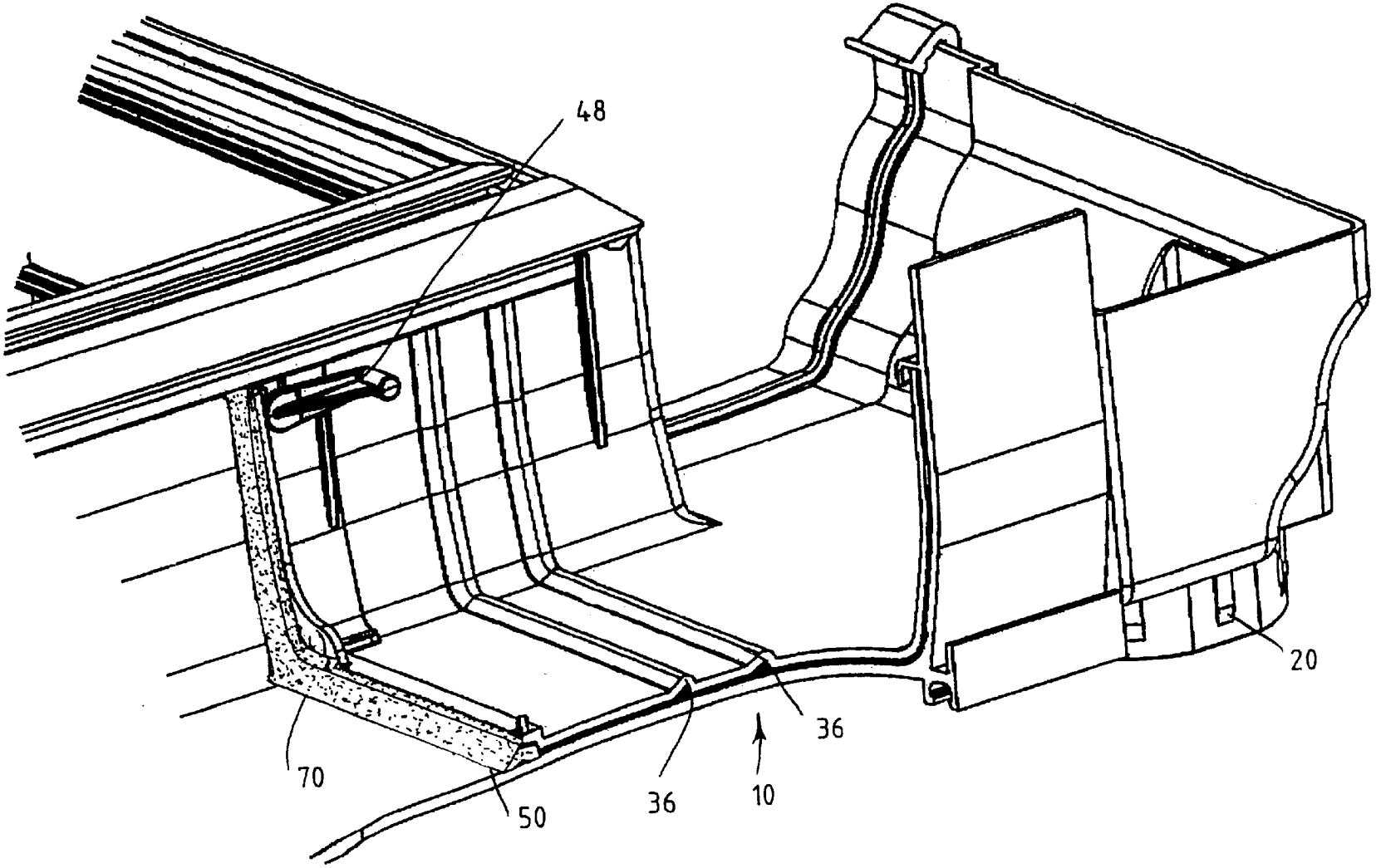

The toggles 48 have a lever 60 and a cam 62 on opposite sides of a pivot pin. The toggle 48 has its lever pointing downwards for fitting of the connector, so that the cam 62 is inoperative. When the toggle levers 60 are pivoted upwards through 90°, the cam 62 acts against the underside of the ribs 28 to force the connector downwards. The toggle levers 60 are locked in position when the pass over stops 64 on the sides of the connector. That has the effect of expelling air trapped in the adhesive by applying downwards pressure and holds the connector in place whilst the adhesive sets. Any excess adhesive/sealant 50 which is squeezed from the joint is then pointed as shown in FIG. 8.

The free end of the limb 18 of the connector has internal ribs 70 on opposite sides for additional strength. The ribs 70 prevent the sides and base of the connector from bending under the pressure executed by the toggles.

What is claimed is:

1. A combination comprising a box gutter, an exterior gutter, and a trough-shaped connector having a first limb and a second limb, the first limb being slidable lengthwise into the box gutter, at a free end of the first limb, and the second limb being connected to the exterior gutter, an adhesive being applied to an inner surface of the box gutter, the first limb comprising means for aiding spread and keying of the adhesive between an outer surface of the first limb and the inner surface of the gutter as the first limb is slid into the box gutter, wherein said means comprises a groove or grooves extending crosswise in the outer surface of the first limb and being shaped to aid spread and keying of the adhesive, between an outer surface of the first limb and the inner surface of the gutter, as the first limb is slid into the box gutter.

2. The combination of claim 1, wherein the or each groove has a first face substantially perpendicular to the outer surface of the first limb and a second face angled forwardly from the first face toward the free end of the first limb.

3. The combination of claim 1, wherein said means comprises precisely two said grooves.

4. The combination of claim 2, wherein said means comprises precisely two said grooves.

* * * * *